US010808892B2

(12) United States Patent
Diamond

(10) Patent No.: US 10,808,892 B2
(45) Date of Patent: Oct. 20, 2020

(54) LIGHT SOURCE FOR A LUMINAIRE

(71) Applicant: Pudsey Diamond Engineering Ltd, Hampshire (GB)

(72) Inventor: Peter James Andrew Diamond, Hampshire (GB)

(73) Assignee: Pudsey Diamond Engineering Ltd, Hampshire (GB)

( * ) Notice: Subject to any disclaimer, the term of this patent is extended or adjusted under 35 U.S.C. 154(b) by 0 days.

(21) Appl. No.: 16/612,652

(22) PCT Filed: May 11, 2018

(86) PCT No.: PCT/GB2018/051281

§ 371 (c)(1),
(2) Date: Nov. 11, 2019

(87) PCT Pub. No.: WO2018/206979

PCT Pub. Date: Nov. 15, 2018

(65) Prior Publication Data

US 2020/0208792 A1 Jul. 2, 2020

(30) Foreign Application Priority Data

May 12, 2017 (GB) ..... 1707673.8
Mar. 16, 2018 (GB) ..... 1804286.1

(51) Int. Cl.
*F21K 9/65* (2016.01)
*F21V 14/06* (2006.01)
(Continued)

(52) U.S. Cl.
CPC ..... *F21K 9/65* (2016.08); *F21V 13/06* (2013.01); *F21V 14/04* (2013.01); *F21V 14/06* (2013.01); *F21Y 2115/10* (2016.08)

(58) Field of Classification Search
CPC . F21K 9/65; F21V 14/06; F21V 14/04; F21V 13/06
See application file for complete search history.

(56) References Cited

U.S. PATENT DOCUMENTS 5,408,389 A 4/1995 Burlingame
2009/0067152 A1 3/2009 Nobayashi
(Continued)

FOREIGN PATENT DOCUMENTS

DE 10 2009 006185 A1 7/2010
DE 10 2010 003123 A1 9/2011

OTHER PUBLICATIONS

International Search Report, European Patent Office, dated Sep. 6, 2018.

(Continued)

*Primary Examiner* — Joseph L Williams
(74) *Attorney, Agent, or Firm* — Bay State IP, LLC

(57) ABSTRACT

The object of the present invention is to provide a light source (101) for a luminaire or lantern, the light source (101) comprising: at least one light emitting diode (LED), a mantle structure (112) with which the LED (101) is fast within the mantle structure (112), the mantle structure (112) being both transparent or at least translucent and arranged to intercept and re-distribute light from the LED and, an optical element (117) in the mantle structure (112) for biasing light from the LED (101) away from a direction in which illumination is unwanted or at least is wanted at reduced intensity. The optical element (117) is angularly adjustable such that the light emitted may be directed.

15 Claims, 6 Drawing Sheets

(51) Int. Cl.

| | |
|---|---|
| ***F21V 14/04*** | (2006.01) |
| ***F21V 13/06*** | (2006.01) |
| *F21Y 115/10* | (2016.01) |

(56) References Cited

U.S. PATENT DOCUMENTS

| | | | |
|---|---|---|---|
| 2010/0157594 | A1 | 6/2010 | Yang |
| 2012/0098404 | A1 | 4/2012 | Kaandorp et al. |
| 2016/0161082 | A1 | 6/2016 | Huang |

OTHER PUBLICATIONS

Written Opinion of the International Searching Authority, European Patent Office, dated Sep. 6, 2018.

LIGHT SOURCE FOR A LUMINAIRE

The present invention relates to a light source for a luminaire.

CROSS REFERENCE TO RELATED APPLICATION

This application is for entry into the U.S. National Phase under §371 for International Application No. PCT/GB2018/051281 having an international filing date of May 11, 2018, and from which priority is claimed under all applicable sections of Title 35 of the United States Code including, but not limited to, Sections 120, 363, and 365(c), and which in turn claims priority under 35 USC 119 to UK Patent Application No. 1707673.8 filed on May 12, 2017 and UK Patent Application No. 1804286.1 filed on March 16, 2018.

In this specification the following terminology is used:

"Light source" means an actual emitter of light, together with closely associated components for controlling spread of light;

"Luminaire" means a complete light unit, including a light source.

In the context of simulating traditional lighting, "lantern" is an alternative term to "luminaire".

An example of a light source in accordance with the above meaning is, a high/low beam headlamp bulb with its two elements in a glass element and a shield to limit light emission from the low beam element to be non-dazzling, whilst the entire headlamp unit including the bulb/light source is a luminaire.

LED light sources as used in street lighting luminaires tend to create pools of light beneath luminaires with reduced lighting between them.

The object of the present invention is to provide an improved luminaire light source.

In our application No 1707673.8 (Our Earlier Application), we described our invention of a light source for a luminaire or lantern. According to the invention there is provided a light source for a luminaire or lantern, the light source comprising:

- at least one light emitting diode (LED),
- a mantle structure with which the LED is fast within the mantle structure, the mantle structure being transparent or at least translucent and
  - arranged to intercept and re-distribute light from the LED and
- an optical element in the mantle structure for biasing light from the LED away from a direction in which illumination is unwanted or at least is wanted at reduced intensity.

We have now developed that invention with the feature of the optical element being angularly adjustable, conveniently with the mantle. Whilst it is preferred that the optical element is a reflector, it is envisaged that other optical elements could be provided, for instance a prismatic device or indeed a light shield.

Indeed in Our Earlier Application, we disclosed a central screw fixing the optical element/reflector within the mantle, together with an indication that it could be positioned to reflect light away from a house.

Our below described, angularly adjustable embodiment has angular adjustment of its mantle with the reflector in it. However, the mantle as such may be dispensed with, with an angularly adjustable support for the reflector alone being provided.

The optical element can be configured to reduce light intensity in one direction, dispersing it generally through other directions, or it can be configured to concentrate light in one or more specific directions. Normally these directions will be around an at least substantially vertical axis, with the LED(s) directed downwards or at least arranged below their PCB. However, the reflector, or other optical device, can be arranged to act in the other plane, so that intensity of emitted light varies with angle to the horizontal with a specific objective of avoiding dazzle of people, normally pedestrians, approaching close to the luminaire or lantern and/or "pooling" of light beneath it.

More than one reflector or optical element may be provided per light source, where light is to be projected in two general directions, such as along two or more roads, although this may be achieved with more flexibility by providing a plurality of light sources per luminaire.

It is envisaged that two, or possibly more, reflectors or optical elements may be provided with respectively different functions. For instance a reflector or element, may be provided beneath the LED(s) for dispersing sideways light emitted downwards that would otherwise dazzle and or pool; whilst another reflector or element may be provided to one side of the LED(s) for concentrating the light in certain specific directions. It should be noted that this concentration is lateral of the general direction of the light emission from the LED(s). In other words, with the light source in an envisaged use orientation, the direction of emission is generally downwards and the direction of reflection is generally sideways.

For instance, a reflector beneath the LED(s) may be cusp-like to direct light sideways. A reflector to one side of the LED(s) may similarly be cusp-like to direct light in two opposite directions and not laterally to those directions. Two such reflectors may be provided on opposite sides of the LED(s). It can also be envisaged that more such reflectors can be provided similarly for illuminating three of four directions.

Further it is envisaged that the optical element for directing sideways light may be at least generally parabolic to direct light in a single direction, with light for another direction coming from a second light source, LED(s) and reflector.

Conveniently the angularly adjustable support, with the mantle where provided, can be adjustably arranged to on a heatsink, or a base therefor, on which the LED(s) and its/their PCB are carried.

Where two light sources are provided, they may utilise a common heatsink. However in the preferred embodiment, respective heatsinks are provided for the light sources.

In the preferred embodiment, the support is clipped onto the heatsink base and provided with sprung detents for preserving the adjustment, the base having a circularly arranged set of depressions with which the detents engage.

For the avoidance of doubt, the following details in italics from Our Earlier Application are applicable for the present development.

Normally the mantle structure will be mounted in use to extend down from a support. However, it could extend up from a support. Both arrangements were used in gas lighting with mantles, which the mantle structure of the invention seeks to emulate.

The LED will normally include a phosphor coating on the diode as such for controlling the colour of its light. It may also include a lens focusing light in a particular direction. The invention is applicable to these LED and other LED structures.

The optical element/reflector can be arranged at the bottom of the mantle structure to spread downwards light to reduce intensity of illumination immediately below the light source, when the mantle structure is top mounted, with the LED at its top.

Additionally or alternatively, the or another reflector can be arranged to one side of the mantle structure to reduce sideways or other direction of illumination as into a house where the luminaire is mounted in a street light.

Normally the mantle structure will be of generally paraboloid shape, with the term "mantle" being derived from a mantle of a gas lamp the mantle structure of the invention being shaped to be able to emulate a gas lamp mantle in certain applications.

The mantle structure could be of glass, preferably frosted to provide for redistribution of light. In the preferred embodiments, the mantle structure is of polymeric material. Preferably it has multiple apertures to assist further redistribution. Conveniently it is produced by so-called 3D printing.

The optical element/reflector can be of polymeric materially also, suitably metallised to be reflective. Alternatively it can be metallic. For instance where the reflector is intended to redirect light from unwanted sideways radiation, the reflector can be thin and formed either as a moulding or a pressing of thin metal. Where the reflector is at the base of the mantle structure to redistribute downwards radiation, as would be the norm with an LED having a focusing lens, the reflector is conveniently generally conical. Such a shape does not lend itself to being thin when centrally secured and as such is conveniently of solid metal.

To help understanding of the invention, a specific embodiment and a variant thereof will now be described by way of example and with reference to the accompanying drawings, in which.

Figure 1:
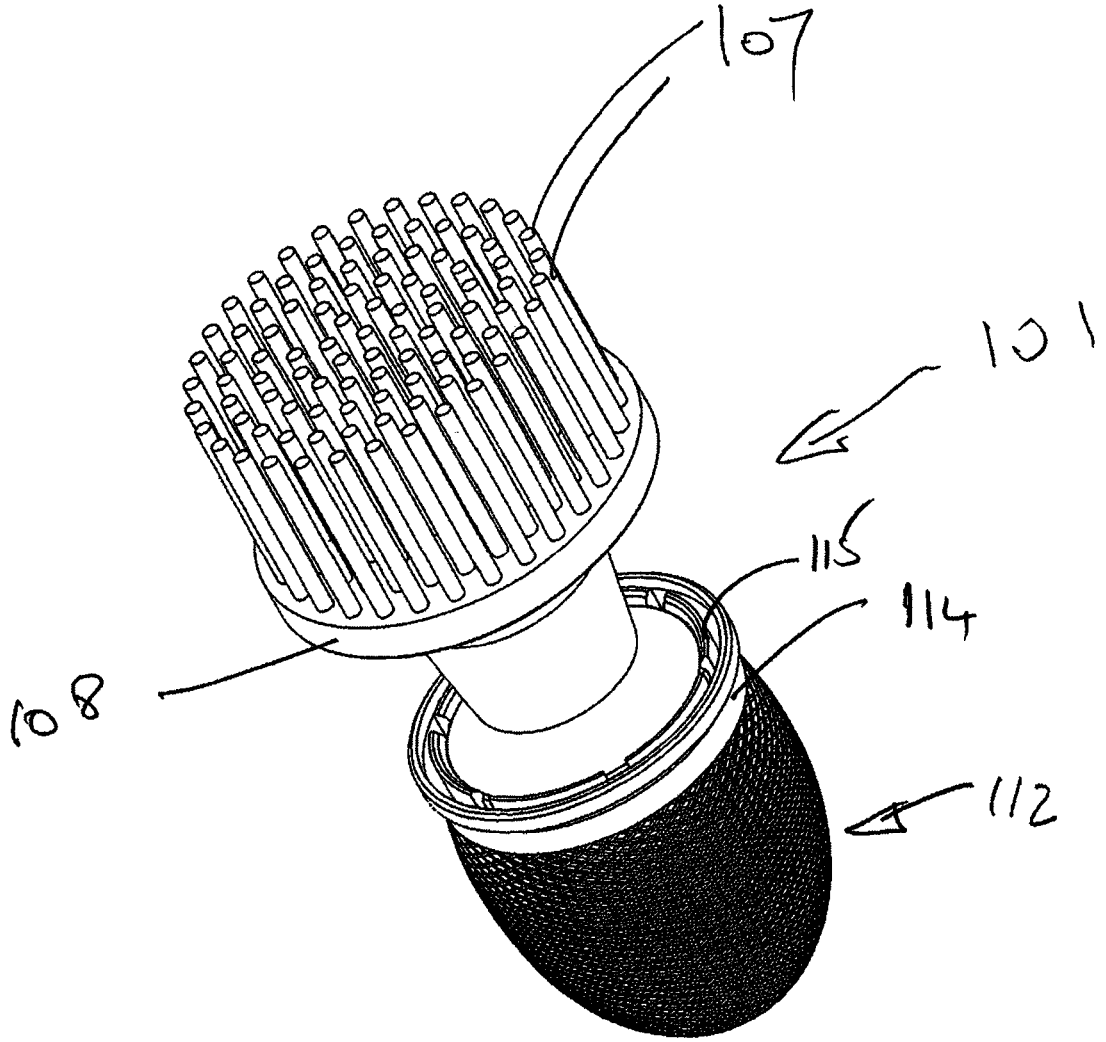
FIG. 1 is a perspective view from above of a developed light source.
Figure 2:
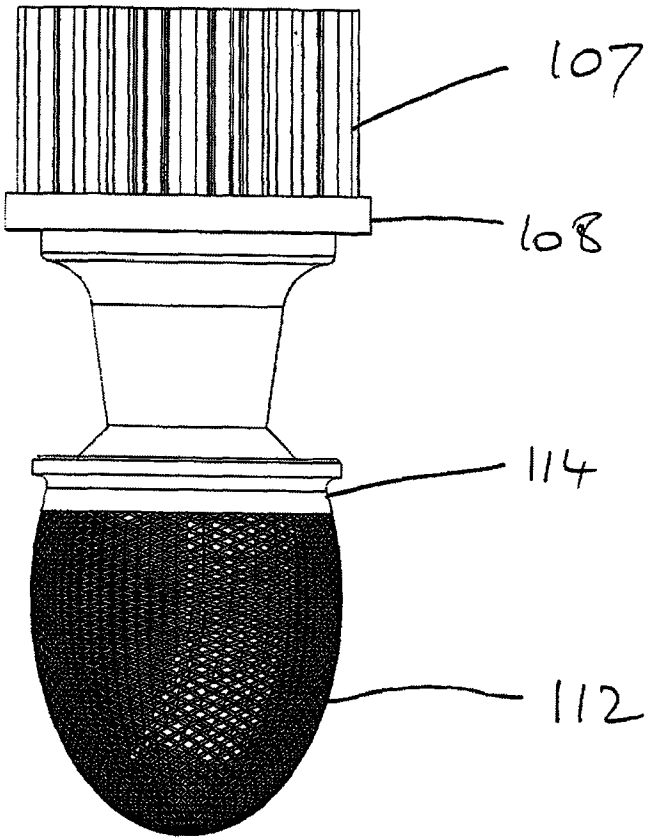
FIG. 2 is a side view of the light source of FIG. 1.
Figure 3:
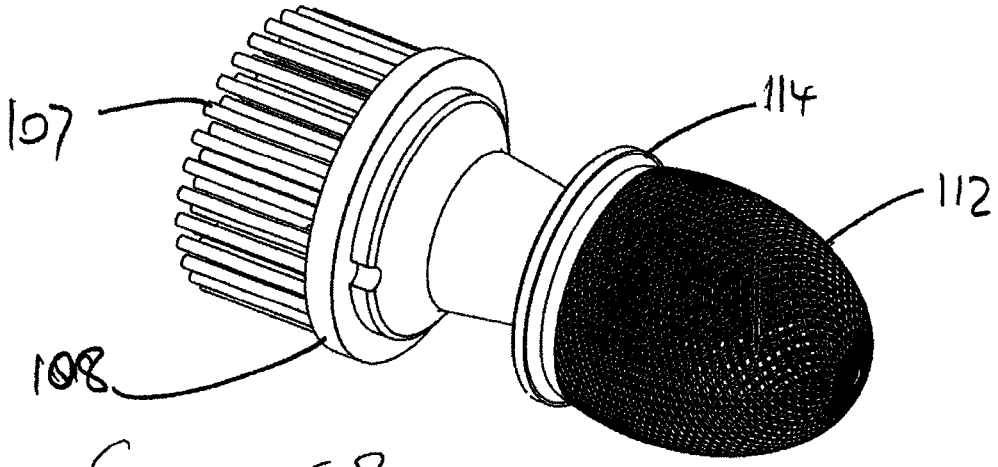
FIG. 3 is a view similar to FIG. 1 of the light source from below (but on its side)
Figure 4:
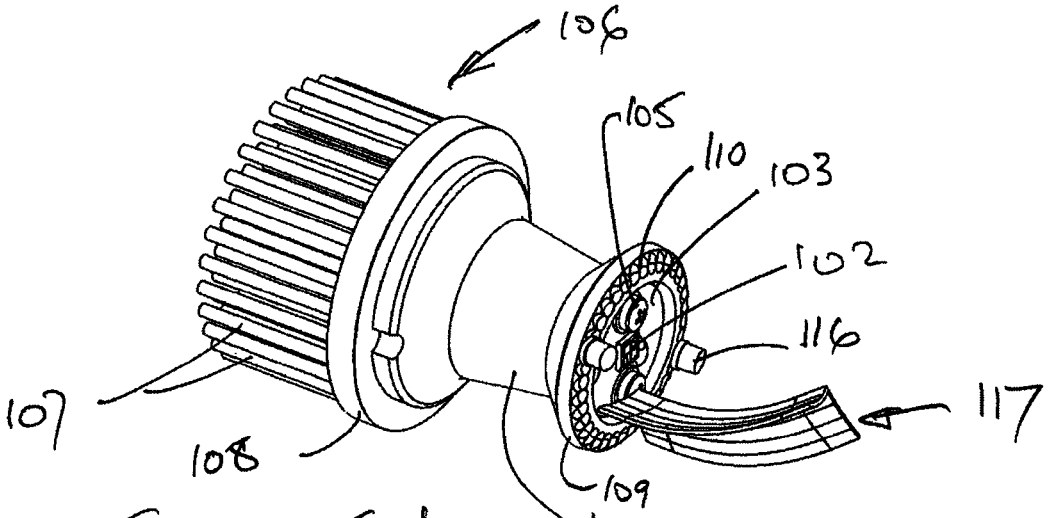
FIG. 4 is the same view as FIG. 3 with the mantle removed from the light source.

Referring to the drawings, the embodiment there shown is of the new development beyond Our Earlier Application.

Referring to FIGS. 1 to 4, the light source 101 has an LED chip unit 102 mounted centrally on a PCB 103. This is held fast onto an LED base 104 by screws 105 passing through the base to a heat dissipater or heat sink 106. The latter has a plurality of pins 107 to increase its surface area and allow heat transfer to surrounding air. The screws engage in a disc 108 of the heat sink, from which disc the pins extend, and they draw the PCB into heat conducting with the LED base.

A details is that the PCB, base and disc are bored for a power supply cable, not shown, to the PCB for illuminating the LEDs.

The base has a rim 109 around the PCB in which a circular array of depressions 110 are milled. A 3D printed mantle 112 has an integral collar 114 with a series of lips 115 arranged to over-hang the rim 109. Thus they hold the mantle to the LED base. The collar has a pair spring detent 116 set in it. The mantle has a reflector 117 set in it.

The detents and the depressions allow the clipped one mantle to be turned around the base to orient the reflector in a desired direction.

As shown, the reflector has length along which it is concavely curved towards the LEDs. It also has a cusp in cross-section transverse to its length whereby it reflects and spreads light incident on it in a sideways direction away from the reflector. The reflector does not have as strong a directional effect as if it were a parabolic reflector or indeed a circular section one, both of which are envisaged to be possible variants. Rather it spreads light incident on it to give broadly directional illumination. It also shields the region behind it which could otherwise but unwantedly illuminated by the LEDs.

Figure 5:
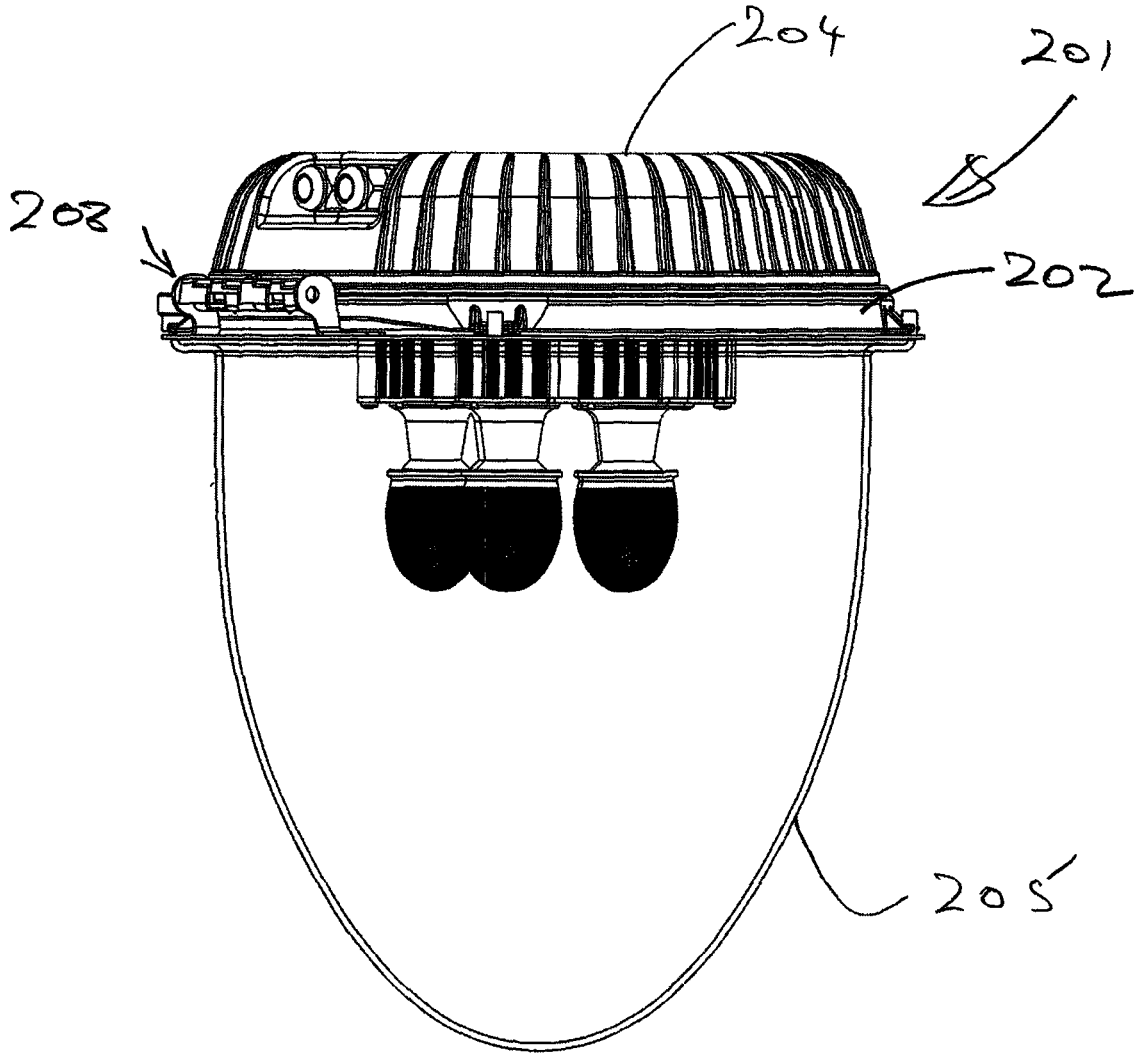
FIG. 5 is a side view of a luminaire with light sources of FIG. 1.
Figure 6:
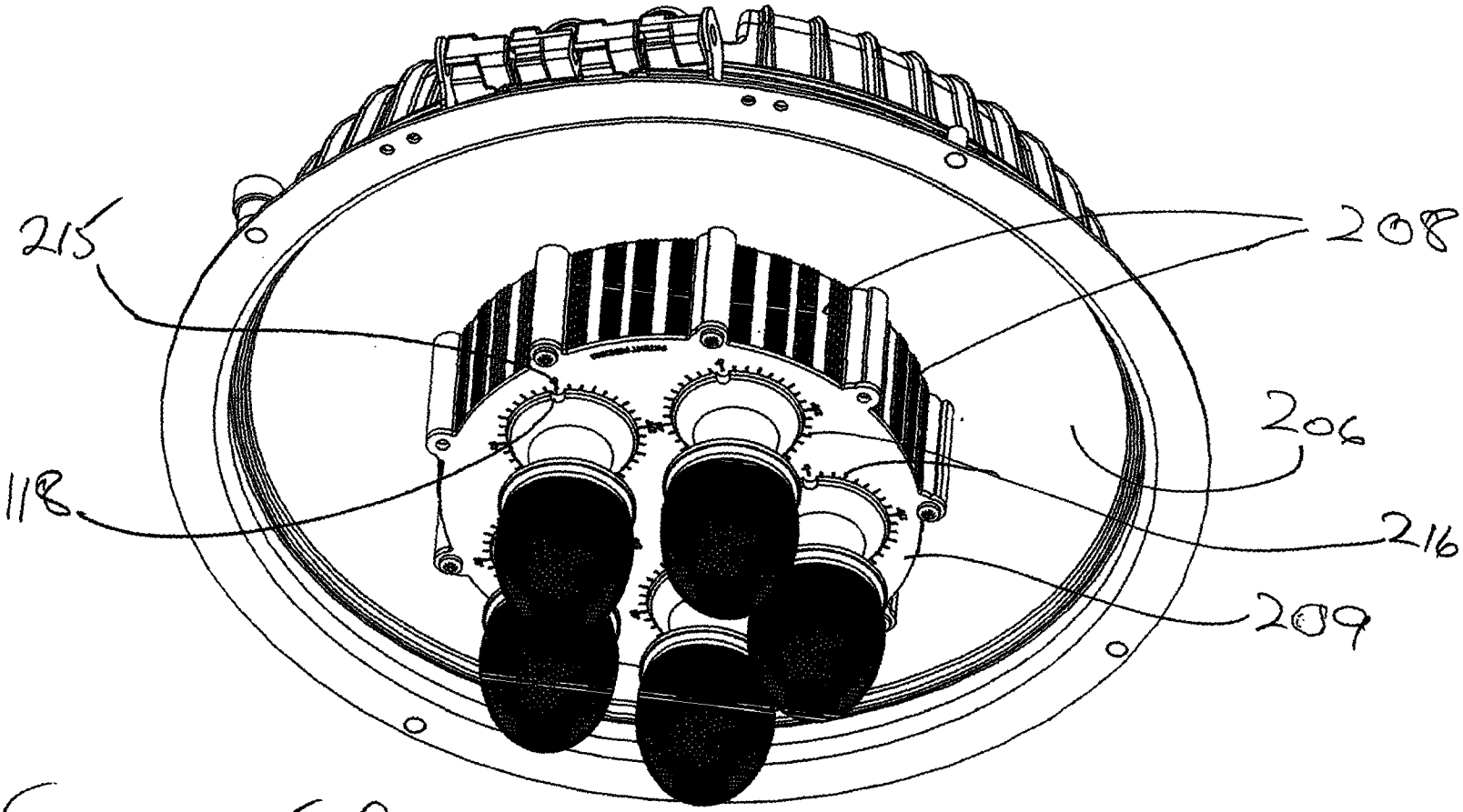
FIG. 6 is a perspective view from below of the luminaire of FIG. 5, with a lower cover removed.
Figure 7:
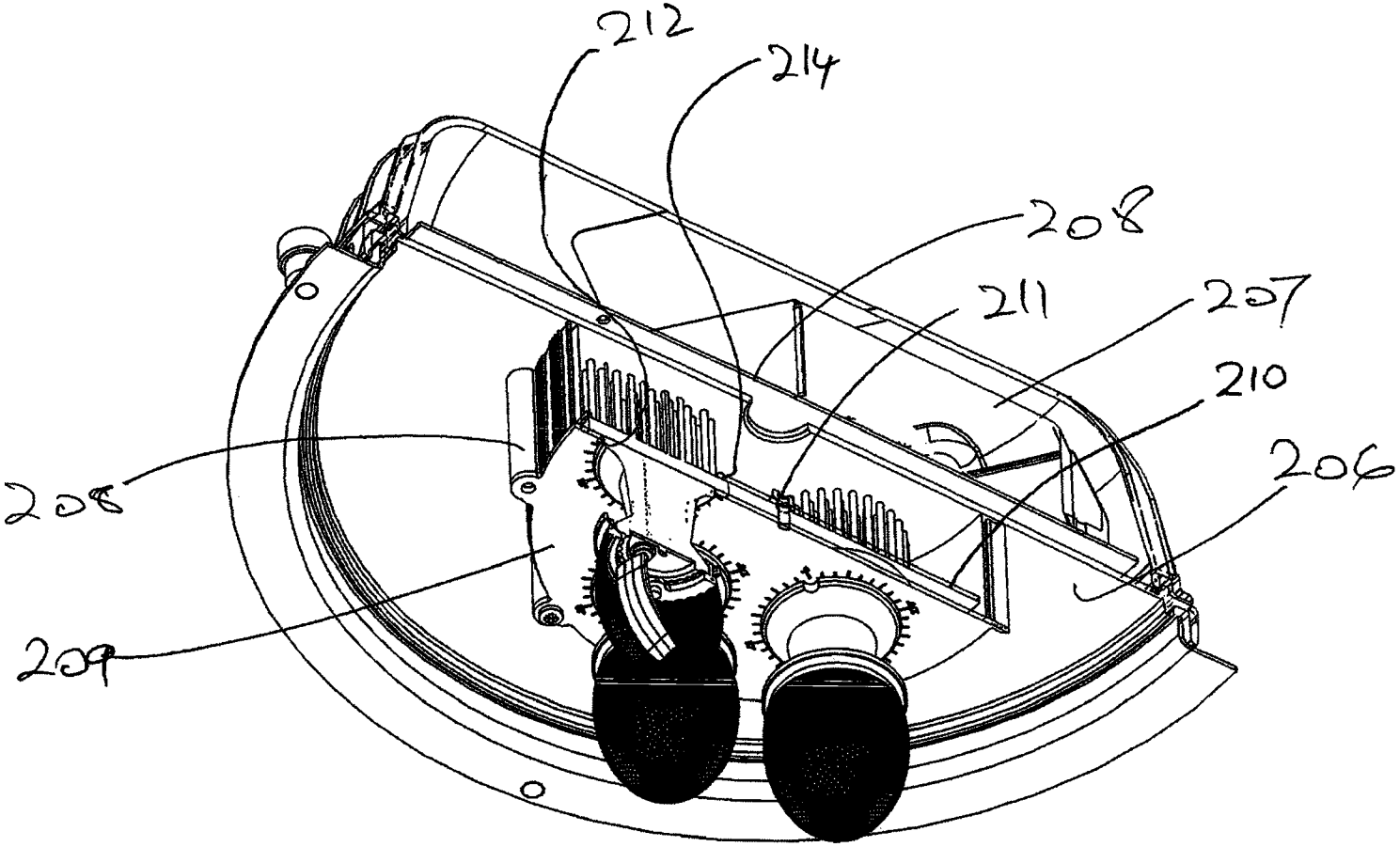
FIG. 7 is a cross-section view of the luminaire of FIG. 6 based on a similar perspective view.

The reflector can be made of polymeric material, suitably metallised to be reflective. Alternatively it can be metallic Turning now to FIGS. 5 to 7, a luminaire 201 for a lamp standard (not shown) has a fixture ring 202 with a hinge 203, via which an upper, opaque cover 204 and a lower transparent cover 205 are hinged to the fixture ring. Remote from the hinge, closure formations are provided, in particular for supporting the transparent cover which extends down from the fixture ring in use.

The fixture ring has an integral plate 206, above which power supply circuitry 207, which is essentially conventional, is supported on a plate 208. Below the plate 206 a circle of inter-engaging spacers 208 is fastened. They carry a lower plate 209 to which a clamping plate 210 is fastened by a central bolt 211. Both plates have respective circular cut-outs 212,214. The lower plate cut-outs are sized to receive the LED bases 104 of a plurality of light sources 101, with their heat sink discs 108 resting on the lower plate. The clamp plate cut-outs receive the heat sink pins 107 of each light source. With the bolt 211 tightened, the light sources are held fast. Their bases have nicks 118 and the lower plate has tabs 215. These inter-engage, where the LED bases are oriented in a pre-set direction. Angular graduations 216 are provided around each at each cut-out 212. Thus the mantles can be rotated to predetermined angles on assembly. Final adjustment of the angle of the mantles and their reflectors can be made after installation, with lower cover open.

The invention is not intended to be restricted to the details of the above described embodiment. For instance, where the appearance of a gas mantle is not required, the mantle can be formed with fewer strands than shown giving a more open appearance, with less secondary emission from them. Indeed it may be continuous and transparent. Further it may be shaped merely as a support around the edge of the reflector, with the support still being integral with the adjustment collar.

The reflector can be more extensive than shown, in particularly angularly. It can also be augmented by a further reflector across the inside of the distal end of the mantle to mitigate light pooling.

It is also envisaged that the reflector may be integrated into the mantle, as with prismatic elements extending around part of the mantle in the manner of a Fresnel lens. Alternatively, the mantle or a vestigial part of it, may be 3D printed and then metallised.

The invention claimed is:

1. A light source for a luminaire or lantern, the light source comprising:

at least one light emitting diode (LED), a mantle structure with which the at least one LED is fast within the mantle structure, the mantle structure being apertured to assist further light redistribution, and: transparent or at least translucent, arranged to intercept and re-distribute light from the LED, and a collar comprising at least a pair of spring detents, at least one optical element in the mantle structure for biasing light from the LED away from a direction in which illumination is unwanted or at least is wanted at reduced intensity, and an LED base upon which the mantle structure is fast, the base having a circularly arranged set of depressions for reciprocal communication with the spring detents, whereby the mantle structure is an angularly adjustable support for the optical element.

2. A light source for a luminaire or lantern according to claim 1, wherein the optical element is angularly adjustable.

3. A light source for a luminaire or lantern according to claim 1, wherein the optical element is any one of:

a reflector, a prismatic device, or a light shield.

4. A light source for a luminaire or lantern according to claim 1, wherein there is provided a central screw fixing the optical element within the mantle.

5. A light source for a luminaire or lantern according to claim 1, wherein the optical element is configurable to:

reduce light intensity in one direction, disperse light generally through other directions, or concentrate light in one or more specific directions.

6. A light source for a luminaire or lantern according to claim 1, wherein more than one optical element and/or light source is provided per luminaire.

7. A light source for a luminaire or lantern according to claim 1, wherein the optical element for directing sideways light is generally parabolic.

8. A light source for a luminaire or lantern according to claim 1, wherein the angularly adjustable support and/or mantle are adjustable arranged on to a heatsink or base therefor, upon which the LED(s) and its/their PCB are carried.

9. A light source for a luminaire or lantern according to claim 8, wherein respective heat sinks are provided for the light sources where there is more than one light source.

10. A light source for a luminaire or lantern according to claim 8, wherein the support is clipped onto the heatsink base and provided with sprung detents for preserving the adjustment.

11. A light source for a luminaire or lantern according to claim 1, wherein the mantle structure is mounted in use to extend down or up from the support.

12. A light source for a luminaire or lantern according to claim 1, wherein the LED has a phosphor coating and/or a lens for focusing the light in a particular direction.

13. A light source for a luminaire or lantern according to claim 1, wherein the optical element is arranged at the bottom of the mantle structure to spread downwards light to reduce intensity of illumination immediately below the light source, and/or the or another reflector can be arranged to one side of the mantle structure to reduce sideways or other direction of illumination.

14. A light source for a luminaire or lantern according to claim 1, wherein the mantle is generally paraboloid in shape.

15. A light source for a luminaire or lantern according to claim 1, wherein the optical element is polymeric with a reflective coating, or metallic.

* * * * *